US008355869B2

(12) United States Patent
Balardeta et al.

(10) Patent No.: US 8,355,869 B2
(45) Date of Patent: Jan. 15, 2013

(54) GOLF GPS DEVICE

(75) Inventors: Joseph Balardeta, Encinitas, CA (US); Scott Denton, Carlsbad, CA (US)

(73) Assignee: Callaway Golf Company, Carlsbad, CA (US)

( * ) Notice: Subject to any disclaimer, the term of this patent is extended or adjusted under 35 U.S.C. 154(b) by 442 days.

(21) Appl. No.: 12/645,963

(22) Filed: Dec. 23, 2009

(65) Prior Publication Data

US 2011/0046880 A1 Feb. 24, 2011

Related U.S. Application Data

(60) Provisional application No. 61/235,614, filed on Aug. 20, 2009.

(51) Int. Cl.
*G08G 1/123* (2006.01)

(52) U.S. Cl. ..... 701/532; 701/412; 701/469; 701/439; 473/407

(58) Field of Classification Search ..... 701/439, 701/469, 526, 412, 454, 487, 532; 473/407; 463/2; 715/764
See application file for complete search history.

(56) References Cited

U.S. PATENT DOCUMENTS 3,898,437 A 8/1975 Butler
4,367,526 A 1/1983 McGeary et al.
4,419,655 A 12/1983 May
4,764,666 A 8/1988 Bergeron
4,910,677 A 3/1990 Remedio et al.
5,043,889 A 8/1991 Lucey
5,095,430 A 3/1992 Bonito et al.
5,127,044 A 6/1992 Bonito et al.
5,214,757 A 5/1993 Mauney et al.
5,245,537 A 9/1993 Barber
5,261,820 A 11/1993 Slye et al.
5,271,034 A 12/1993 Abaunza
5,319,548 A 6/1994 Germain
5,326,095 A 7/1994 Dudley
5,364,093 A 11/1994 Huston et al.
5,434,789 A 7/1995 Fraker et al.
5,438,518 A 8/1995 Bianco et al.
5,469,175 A 11/1995 Boman
5,507,485 A 4/1996 Fisher
5,524,081 A 6/1996 Paul
5,528,248 A 6/1996 Steiner et al.
5,528,518 A 6/1996 Bradshaw et al.
5,558,333 A 9/1996 Kelson et al.
5,664,880 A 9/1997 Johnson et al.
5,685,786 A 11/1997 Dudley
5,689,431 A 11/1997 Rudow et al.
5,699,244 A 12/1997 Clark, Jr. et al.
5,740,077 A 4/1998 Reeves
5,772,534 A 6/1998 Dudley
5,779,566 A 7/1998 Wilens
5,797,809 A 8/1998 Hyuga
5,802,492 A 9/1998 DeLorme et al.
5,810,680 A 9/1998 Lobb et al.
5,835,896 A 11/1998 Fisher et al.
(Continued)

*Primary Examiner* — Gertrude Arthur Jeanglaude
(74) *Attorney, Agent, or Firm* — Michael A. Catania; Sonia Lari; Rebecca Hanovice

(57) ABSTRACT

A golf GPS device is disclosed herein. The device includes a GPS unit, a memory for storing data for a plurality of golf courses, a display for displaying animations of portions of golf courses, a user input for inputting a plurality of location points on the display, and a processor comprising means for rendering the animations of portions of golf courses from a plurality of latitude and longitude coordinate points.

12 Claims, 16 Drawing Sheets

U.S. PATENT DOCUMENTS

| | | | | |
|---|---|---|---|---|
| 5,873,797 | A | 2/1999 | Garn | |
| 5,878,369 | A | 3/1999 | Rudow et al. | |
| 5,882,269 | A | 3/1999 | Lewis | |
| 5,904,727 | A | 5/1999 | Prabhakaran | |
| 5,949,679 | A | 9/1999 | Born et al. | |
| 6,029,121 | A | 2/2000 | Stashko | |
| 6,060,991 | A | 5/2000 | Hsieh | |
| 6,111,541 | A | 8/2000 | Karmel | |
| 6,171,199 | B1 | 1/2001 | Cohodas et al. | |
| 6,263,279 | B1 | 7/2001 | Bianco et al. | |
| 6,456,938 | B1 | 9/2002 | Barnard | |
| 2004/0147329 | A1 * | 7/2004 | Meadows et al. | 473/131 |
| 2005/0113124 | A1 * | 5/2005 | Syrjarinne et al. | 455/522 |

* cited by examiner

GOLF GPS DEVICE

CROSS REFERENCES TO RELATED APPLICATIONS

The Present Application claims priority to U.S. Provisional Patent Application No. 61/235,614, filed On Aug. 20, 2009.

STATEMENT REGARDING FEDERALLY SPONSORED RESEARCH OR DEVELOPMENT

Not Applicable

BACKGROUND OF THE INVENTION

1. Field of the Invention

The field of the invention generally relates to electronic devices which utilize the global positioning system ("GPS") to determine locations and distances, and more particularly to a GPS device for determining distances to features on a golf course, and displaying the distances to features, golf course animations, and/or other golf related data. The invention also relates to systems and methods for supporting such a GPS device.

2. Description of the Related Art

In golf, there is always a need for more information. Knowing more information about the course being played gives players of all abilities a better chance to improve their game or make the right shot choice. Standard golf GPS provides distance to the front, middle and back of the green. This is typically not enough information for players to make the best choices. Having the ability to measure to or from anything on the golf course provides detailed information which quickly becomes indispensable.

Currently, the only competing solutions allow either movement limited only to the Green, or in another case, allows movement of a measurement point around a representation of the hole however does not allow measurement to or from anything on the course. In the former case, a crosshair can be moved around the area of the green, allowing limited functionality. In the latter case, the cursor movement covers the whole course, however the measurement is always from the current user location to the cursor, and from the cursor to a selected point on the green.

Various golf GPS devices, both handheld and golf cart-mounted, have been previously disclosed and described in the prior art. Generally, these devices comprise a GPS receiver and processing electronics (the "GPS system"), a display such as a liquid crystal display ("LCD") or cathode ray tube ("CRT"), and a user input device such as a keypad. Golf course data is input and stored in the golf GPS device, including for example, the coordinates for locations of greens, bunkers and/or other course features. These types of devices use the GPS system to determine the location of the device. Then, the device calculates and displays the distances to the various golf course features, such as the distance to the front, middle and back of the green, or the distance to a bunker or water hazard. Accordingly, by placing the device at or near the golfer's ball, the device can relatively easily and accurately provide the golfer with important distance information usable while playing golf. For example, the distance information is used by the golfer to formulate strategy for playing a hole (sometimes called "course management") and for club selection.

As an example of a golf GPS device, U.S. Pat. No. 5,507,485 ("the '485 patent"), which is hereby incorporated by reference herein in its entirety, purports to disclose a golf GPS device which can display depictions of a golf hole including multiple, selectable views of each hole such as the approach to the green and the green itself. The '485 patent describes that the device is configured to automatically determine the location of the device using a GPS receiver and then automatically display the golf hole view that would be of immediate interest to the golfer. Although the '485 patent discloses that the distance to displayed features may be indicated on the display, there is no description of how or where such information is displayed. The '485 patent also describes that the device may include other features such as means for receiving climate (i.e. temperature and humidity) and weather (i.e. wind speed and direction) conditions, means for recording and computing scores, bets and handicaps, means for recording details of a golf game sufficient to later replay and analyze a round of golf, means for suggesting shot and club selections to the golfer, clubs used and distances obtained for shots, and means for updating daily tee and hole positions on a removable integrated circuit ("IC") card. The course data for each particular course is also described as being stored on removable IC cards which are interchangeable between a host computer and the golf computer.

However, the '485 patent does not describe how the course data is generated, or how daily tee and hole positions are determined. The means for updating and supplying course data through removable IC cards which are programmed on a host computer and then inserted into the golf computer is clumsy and inconvenient. Moreover, the '485 patent only describes a cart-based golf computer, and although the '485 patent suggests that portions of the device (the display and input means) could be implemented on a handheld unit such as the Apple Computer Company's NEWTON™, there is no enabling disclosure of a fully integrated, standalone, handheld golf GPS device.

U.S. Pat. No. 6,456,938 ("the '938 patent"), which is hereby incorporated by reference herein in its entirety, describes a handheld golf GPS device. The handheld device is described as software executed on a palm-held computer (PC) saddled into and connected directly to a dGPS (differential global positioning system or differential GPS) receiver. The handheld device of the '938 patent has a modular construction comprising a dGPS receiver module which receives and accommodates a display module. The display module is described as being any of a variety of handheld, multifunctional computing devices having a display screen and a processor running an operating system. Suitable display modules disclosed include Personal Data Assistants (PDAs), such as a Pocket PC, PALM® PDA, or similar palm held computing device. The screen is split into two distinct sections, a course display section for displaying a graphic representation of an area of a golf course, and a separate data and menu display section for displaying touch sensitive menu buttons and data (including distances). In the disclosed embodiment, the majority of the screen includes the first section, and a thin, left column of the screen shows a vertical menu column of touch sensitive menu buttons and data, such as distances.

The '938 patent also describes that the handheld golf GPS device could be constructed so that the modules are integrated into one unit, but does not describe the construction of such an "integrated" unit in any detail.

The '938 patent describes various functionality of the handheld golf GPS device, methods of creating golf course maps, and methods of distributing the golf course maps to the handheld golf GPS devices. For example, to use the device of the '938 patent during a round of golf, course data is first loaded onto the device. This may be accomplished by mapping the course using the device and using that course data file, as discussed below, or by connecting the device to a personal computer (PC) or directly to an interne connection and downloading the course data file onto the device. There is a setup menu for setting player preferences such as: club selection and data gathering; lie and stroke tracking enabled/disabled; marking of green strokes; and setting the green reference point, system units, and course, tee and starting hole selections. Once the course, tee and starting hole have been selected, the device displays a graphical (icon) representation of the selected hole, and certain distances to features whose locations are pre-stored in the course data file is displayed only in the data and menu section of the display. For example, the distance to the center of the green may be displayed in one of the boxes in the data and menu section of the display. The graphical representation includes simple icons for various features to be shown on the display, as shown in FIG. 29 of the '938 patent. At any time, the location of the device is determined using the dGPS receiver.

The device of the '938 patent also includes a club selection feature, in which the average distance for the player's clubs is displayed for each shot during play. The device also includes features for distance measuring from the location of the device to a target marked on the display by the user. Another described feature of the device is a shot tracking method which allows the user to store the location of each shot and the club used for the stroke at such location. Several other features are described in the '938 patent, including display functions such as pan and zoom, score keeping, statistics tracking, and the ability to upload game shot data to a web site or PC and then view a replay of a round with the speed of replay being adjustable.

Another example of a handheld golf GPS device is the Skycaddie™ line of devices from Skygolf®. At present, there are four models of Skycaddies with various levels of functionality and features. Like the devices described in the '485 patent and the '938 patent, the golf course data is loaded into the Skycaddie device. As described by Skygolf, the golf course data is generated by mapping each course on the ground using GPS and survey equipment. The database of golf course data is accessible through the internet on Skycaddie's website. The golf course data is downloaded onto a PC and then may be loaded onto the Skycaddie device by connecting the device to the PC. In addition, the Skycaddie devices allow a user to map a course, or additional course features, in the event a course or feature of interest is not included in the Skygolf database.

Another example of a handheld golf GPS device is the Skycaddie™ line of devices from Skygolf®. At present, there are four models of Skycaddies with various levels of functionality and features. Like the devices described in the '485 patent and the '938 patent, the golf course data is loaded into the Skycaddie device. As described by Skygolf, the golf course data is generated by mapping each course on the ground using GPS and survey equipment. The database of golf course data is accessible through the internet on Skycaddie's website. The golf course data is downloaded onto a PC and then may be loaded onto the Skycaddie device by connecting the device to the PC. In addition, the Skycaddie devices allow a user to map a course, or additional course features, in the event a course or feature of interest is not included in the Skygolf database.

Certain models of the Skycaddies may also display an outline of the green for a selected hole with the distances to the front, center and back of green displayed to the side of the displayed outline. Some models also display an icon representation of certain features, such as a creek, bunker or green, in one section of the display and the distances to such features in a different section of the display next to the icons. The Skycaddie devices can only measure distance to locations which are not pre-stored in the course data by marking a starting location and then moving the device to the measured location and marking the ending location. The device will then display the distance between the two locations. However, this requires walking all the way to the measured location. The Skycaddie devices are configured to automatically advance to the next hole of play based on the location of the device.

However, none of the previously described golf GPS devices provides a convenient, pocket-sized form factor, a high-resolution color display capable of storing data for tens of thousands of golf courses, flexible calibration to improve accuracy, or the functionality and ease of use to take full advantage of such features. Accordingly, there is a need for an improved golf GPS device which overcomes the deficiencies and drawbacks of previous devices and systems.

BRIEF SUMMARY OF THE INVENTION

The present invention allows for a single device to store data for a plurality of golf courses and then render animations of portions of the golf course based on the data to display on a screen of a device for a golfer to determine the distance to points of interest on the portions of the golf course. The device preferably stores data for 1000 to 50,000 golf courses, more preferably data for 10,000 to 40,000 golf courses and most preferably data for 30,000 golf courses.

The device allows the golfer to truly measure to or from anything on the course. When entering Anypoint, a cursor is positioned in the center of the current viewport. This cursor is moveable by the user using any number of input methods. Initially, when the user moves the cursor, the measurement takes place from the current user location to the cursor. This measurement gets updated as both the user location moves, and the position of the cursor changes. If the user presses the select button, this starts a new measurement. There will then be two measurements on the screen at the same time. One measurement will still be from the cursor to the current user location. The other measurement will be from the cursor to the point where the user pressed the select button. A second press of the select button stops the $2^{nd}$ measurement, and leaves the measurement on the screen. Using this sequence of events, the user can easily perform layup measurements by putting the cursor at the approximate pin location on the green, then pressing the select button and moving the cursor to whatever their favorite yardage is into the green. They will then have two measurements showing—one from their current location so they know what club to hit, and another measurement showing their ideal yardage into the green. Also using this sequence, a user can measure things like the width of a fairway, different characteristics of hazards, and anything else that they need additional information on. This is superior to competing solutions both in terms of the level of information supplied, but also in usability.

The present invention comprises a portable golf GPS device and system which is simple, accurate, and easy to use, yet provides excellent functionality and features in a compact, lightweight form factor. The portable golf GPS device of the present invention generally comprises a microprocessor operably coupled to a GPS unit, an input device such as a keypad (or touch screen) operably coupled to the microprocessor, and a display such as a liquid crystal display ("LCD") operably coupled to the microprocessor. A program memory system which contains at least some of the software and data to operate the device is also operably coupled to the microprocessor. The device also comprises various firmware and software configured to control the operation of the device and provide the device functionality as described in more detail below. In addition, data utilized by the device, such as golf course data and type region animations, may be stored in the program memory or other memory module such as Secure Digital memory card ("SD Card"), USB based memory devices, other types of flash memory, or the like.

For portability, the golf GPS device of the present invention is self-contained, compact and lightweight. For example, the device is preferably battery operated. The portable golf GPS device is preferably contained in a housing such that the entire device has a very compact and lightweight form factor, and is preferably handheld and small enough to fit comfortably in a pocket of a user's clothing. For example, the entire golf GPS device may be 4 inches long (4"), by 2 inches wide (2"), by 0.6 inches thick (0.6"), or smaller in any one or more of the dimensions. The entire golf GPS device may weigh 3.5 ounces or less, including the battery.

The microprocessor may be any suitable processor, such as one of the MX line of processors available from Freescale Semiconductor or other ARM based microprocessor. The GPS unit may be any suitable GPS microchip or chipset, such as the NJ1030/NJ1006 GPS chipset available from Nemerix, Inc. The LCD is preferably a high resolution (e.g. 320 pixels by 240 pixels, QVGA or higher resolution), full color LCD, having a size of about 2.2" diagonal The program memory may include one or more electronic memory devices on the golf GPS device. For example, the program memory may include some memory contained on the microprocessor, memory in a non-volatile memory storage device such as flash memory, EPROM, or EEPROM, memory on a hard disk drive ("hdd"), SD Card(s), USB based memory devices, other types of flash memory, or other suitable storage device. The program memory stores at least some of the software configured to control the operation of the device and provide the functionality of the golf GPS device.

The components of the portable golf GPS device are preferably assembled onto a PCB, along with various other electronic components used to control and distribute the battery power, thereby providing the electronic connections and operability for a functional electronic device.

The hardware and software of the portable golf GPS device are configured to determine, track, and display useful golf related information, before, during and after a round of golf. For example, the GPS device is configured to store golf course data for a particular golf course of interest which is loaded onto the GPS device. The golf course data includes geographic location coordinates for various golf course features, such as bunkers, greens, water hazards, tees, and the like. The golf course data may also include golf hole data such a par, handicap, daily tee and hole locations, etc.

The use of the GPS device during play of a round of golf is referred to herein as "Play Golf" mode. In Play Golf mode, the basic functionality of the device is as follows. First, the golf course being played is selected on the GPS device, for example, from a list of courses displayed on the display. Then, the user should locate the GPS device at a location of play (e.g. the location of the user's ball, or a tee box). The GPS device determines the location of the device, and then displays various golf hole information on the display. For example, the device may display the number of the particular golf hole being played, par for the hole, the length of the hole, and the handicap of the hole. The device may also display information regarding the distance to various features of the golf hole being played and an identification of the type of feature. For example, the display may show the front and carry distance of bunkers, the front, middle and back of the green, the front and carry distance of water hazards, and the like.

Accordingly, a portable golf GPS device and system is provided. Additional aspects and features of the portable golf GPS device and system of the present invention will become apparent from the drawings and detailed description provided below.

DETAILED DESCRIPTION OF THE INVENTION

Figure 1:
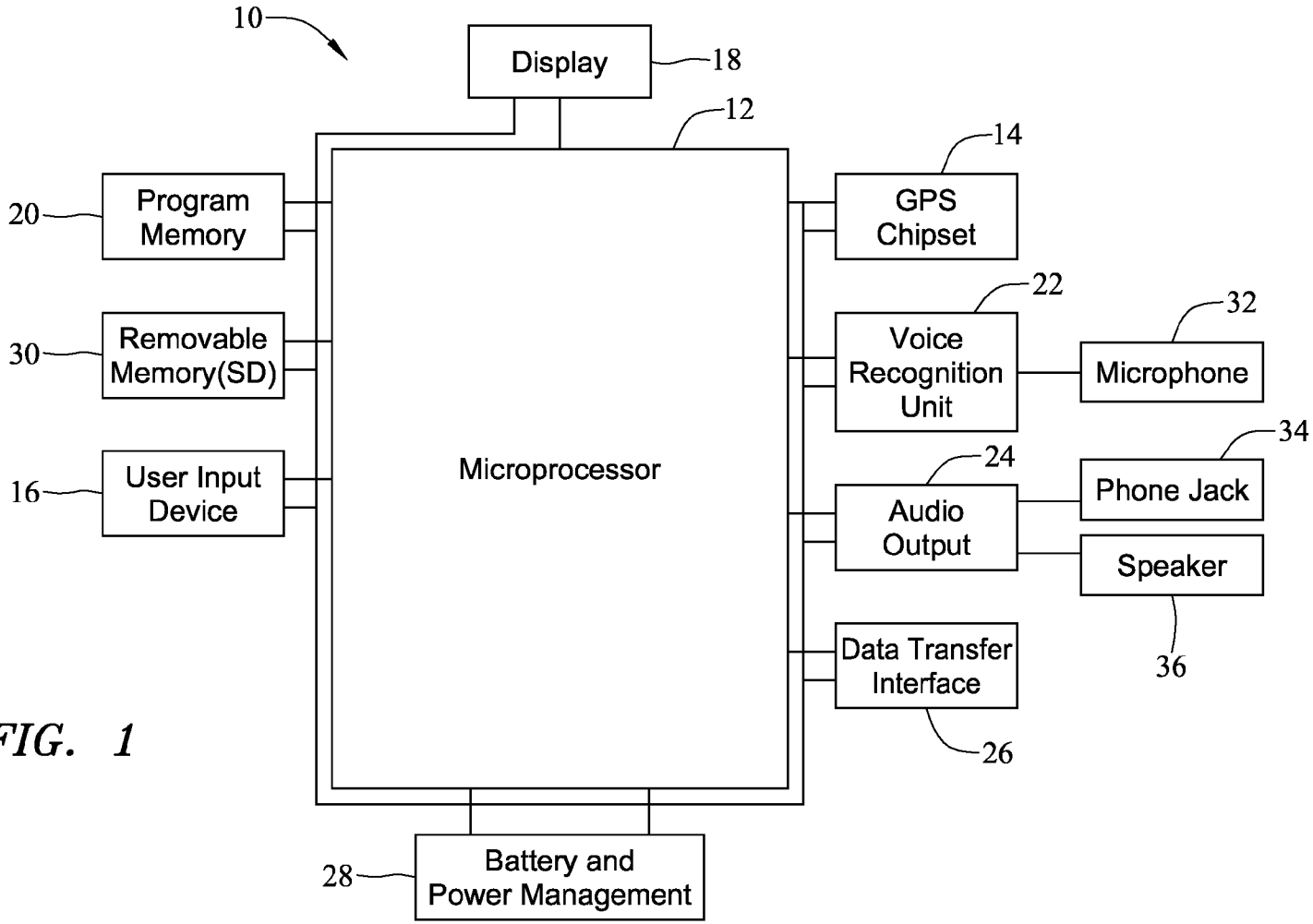
FIG. 1 is a schematic block diagram of a golf GPS device according to one embodiment of the present invention.
Figure 2A:
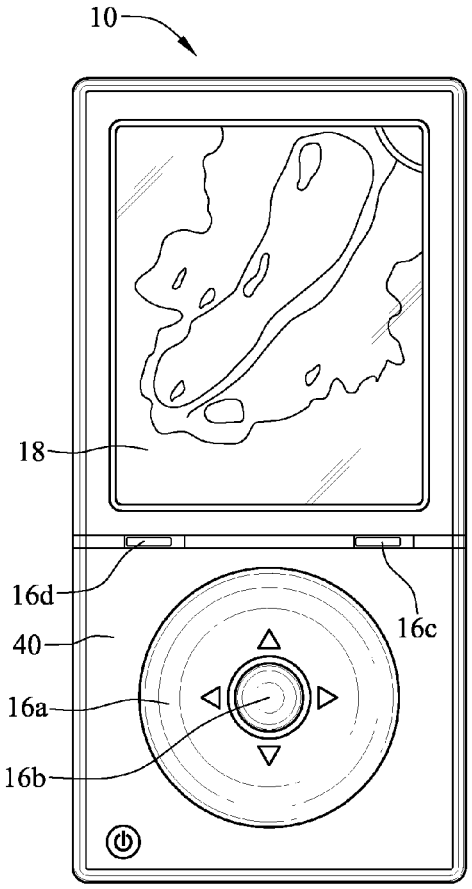
FIG. 2 is a four view showing the front, left side, right side, top and bottom of a golf GPS device according to one embodiment of the present invention.
Figure 2B:
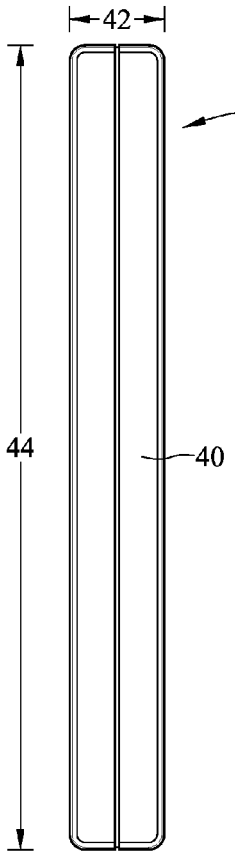
Figure 2C:
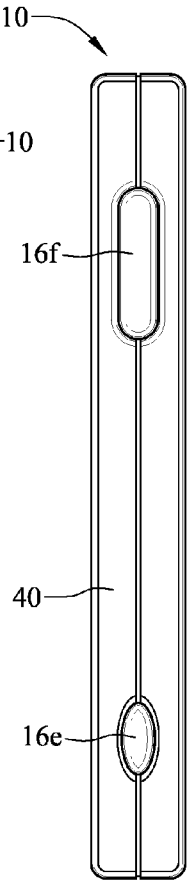
Figure 2D:
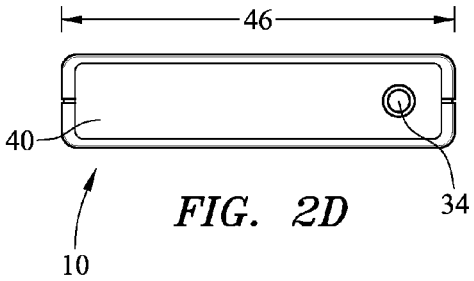
Figure 2E:
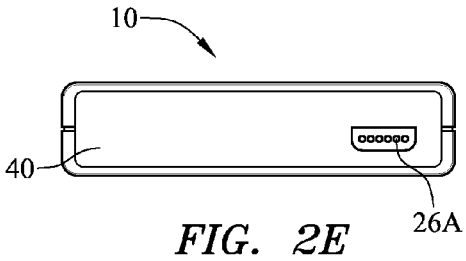

Referring to FIG. 1, a schematic block diagram of the major electronic components of a golf GPS device 10 according to one embodiment of the present invention will be described. The golf GPS device 10 comprises a microprocessor 12 which is operably coupled to a GPS chipset 14, a user input device 16, an LCD display 18; a program memory 20, a voice recognition module 22, an audio output 24, a data transfer interface 26, and a battery and power management unit 28. As understood by one of ordinary skill in the art, the device 10 also comprises other electronic components, such as passive electronics and other electronics configured to produce a fully functional GPS device as described herein. In addition, the device 10 comprises various firmware and software configured to control the operation of the device 10 and provide the device functionality as described in more detail below.

The microprocessor 12 is preferably an ARM based microprocessor, such as one of the MX line of processors available from Freescale Semiconductor, but may be any other suitable processor. The microprocessor 12 executes instructions retrieved from the program memory 20, receives and transmits data, and generally manages the overall operation of the GPS device 10.

The GPS chipset 14 is preferably an integrated circuit based GPS chipset which includes a receiver and microcontroller. The GPS chipset may be a single, integrated microchip, or multiple microchips such as a processor and a separate receiver which are operably coupled to each other (for example, on a printed circuit board ("PCB")). For instance, the GPS chipset 14 may be a NJ1030 GPS chipset available from Nemerix, Inc., or any other suitable GPS chipset or microchip. The GPS chipset includes a GPS receiver, associated integrated circuit(s), firmware and/or software to control the operation of the microchip, and may also include one or more correction signal receiver(s) (alternatively, the correction signal receiver(s) may be integrated into a single receiver along with the GPS receiver). As is well known, the GPS unit 14 receives signals from GPS satellites and/or other signals such as correction signals, and calculates the positional coordinates of the GPS unit 14. The GPS device 10 utilizes this positional data to calculate and display distances to features or selected locations on a golf course, as described in more detail below.

The display 18 may be any suitable graphic display, but is preferably a high resolution (e.g. 320 pixels by 240 pixels, QVGA or higher resolution), full color LCD. The display 18 is preferably the largest size display that can be fit into the form factor of the overall device 10, and preferably has a diagonal screen dimension of between about 1.5 inches and 4 inches. For example, for the form factor described below with reference to FIG. 2, the display may be a 2.2" diagonal, QVGA, full color LCD. In addition, since the display 18 is intended to be used outside under sunlit conditions, the display 18 should provide good visibility under brightly lit conditions, such as with a transflective LCD.

The program memory 20 stores the software and data used to control and operate the device 10. For example, the program memory 20 stores the operating system (such as LINUX or Windows CE), the application software (which provides the specific functionality of the device 10, as described below), and the golf course data. The program memory 20 broadly includes all of the memory of the device 10, including memory contained on the microprocessor, memory in a non-volatile memory storage device such as flash memory, EPROM, or EEPROM, memory on a hard disk drive ("hdd"), SD Card(s), USB based memory devices, other types of flash memory, or other suitable storage device, including one or more electronic memory devices on the golf GPS device, including an additional removable memory unit 30.

The user input device 16 may comprise a plurality of buttons, a touch screen, a keypad, or any other suitable user interface which allows a user to select functions and move a cursor. Referring to the embodiment shown in FIG. 2, an example of a user input device comprises a directional pad 16*a* and plurality of buttons 16*b*, 16*c*, 16*d*, 16*e* and 16*f*. The device 10 is configured such that directional pad 16*a* may be used to move a cursor around the display, while the buttons 16*b*-16*f* may be used to make selections and/or activate functions such as activating the voice recognition or switching between modes (as described in more detail below).

In order to provide portability, the golf GPS device 10 is preferably battery powered by a battery and power management unit 28. The battery may be any suitable battery, including one or more non-rechargeable batteries or rechargeable batteries. For instance, a rechargeable, lithium-ion battery would work quite well in this application, as it provides relatively long life on a single charge, it is compact, and it can be recharged many times before it fails or loses significant capacity. The power management unit controls and distributes the battery power to the other components of the device 10, controls battery charging, and may provide an output representing the battery life. The power management unit may be a separate integrated circuit and firmware, or it may be integrated with the microprocessor 12, or other of the electronic components of the device 10.

The voice recognition unit 22 comprises electronics and software (the term "software" as used herein shall mean either software or firmware, or any combination of both software and firmware) configured to receive voice or other sounds and convert them into software commands and/or inputs usable by the main application software. The voice recognition unit 22 may comprise a separate integrated circuit, electronics and/or software, or it may be integrated into the main microprocessor 12. The voice recognition unit 22 includes a microphone 32. The voice recognition unit 22 is configured to detect voice and/or other sound inputs from a user of the device 10, and convert the sound inputs into electrical signals. The voice recognition unit 22 then digitizes the analog electrical signals and computes a command or other input representative of the digitized signal. For example, a command for switching between Pro Mode and Basic Mode may be input using the voice recognition unit 22 by speaking the term "Pro Mode" or "Basic Mode" into the microphone 32. Of course, the main application software must also be configured to receive the inputs from the voice recognition unit 22. The hardware and software for the voice recognition unit are relatively complex, but packaged solutions are available, such as the products available from Texas Instruments, Inc. or Wolfson Micro, Inc.

The audio output 24 comprises electronics and software to convert digital signals from the device into electrical signals for driving a speaker or headphones. The audio output 24 may comprise a phone jack 34 (also shown in FIG. 2) and/or a speaker 36. The audio output 24 typically includes a digital-to-analog converter, a power amplifier, and may also include software for converting information or data into audible sounds. For instance, the audio output 26 may be configured to convert distances measured by the device 10 into an audibly replicated voice of the distance in words, such as "one-hundred fifty." Additionally, the device 10 may be configured to also play digital music files (such as MP3 audio files) or digital video files (such as MPEG files), with the audio being output using the audio output 24.

The voice recognition unit 22 and audio output 24 may be integrated together into a software and hardware unit. For example, such integrated products are available from Texas Instruments, Inc. and Wolfson Micro, Inc.

The data transfer interface 26 is configured to send and receive data from a computer or other electronic device (e.g. another golf GPS device 10). The interface 26 may be a physical connection such as a USB connection, a radio frequency connection such as Wi-Fi, wireless USB, or Bluetooth, an infra-red optical link, or any other suitable interface which can exchange electronic data between the GPS device 10 and another electronic device. As shown in one preferred embodiment in FIG. 2, the interface 26 comprises a USB connection having a USB connector 26*a*.

The electronic components of the golf GPS device 10 are preferably assembled onto a PCB, along with various other electronic components and mechanical interfaces (such as buttons for the user input device 16), thereby providing the electronic connections and operability for a functional electronic GPS device 10.

Turning to FIG. 2 now, the golf GPS device 10 preferably comprises a housing 40 which houses the electronic components such that the entire device has a very compact, thin, and lightweight form factor. The housing 40 may be formed of any suitable material, but is preferably a plastic material which is substantially transparent to radio frequency signals from GPS satellites. Indeed, the golf GPS device is preferably handheld and small enough to fit comfortably in a pocket of a user's clothing. One example of the form factor for the GPS device 10 with dimensions is shown in FIG. 2. In one preferred form, the GPS device 10 may have the following dimensions: a height 44 of about 4 inches or less, a width 46 of 1.9 inches or less and a thickness 42 of 0.6 inches or less. More preferably, the height 44 is 3.9 inches or less, the width 46 is 1.8 inches or less, and the thickness 42 is 0.55 inches or less. The entire golf GPS device 10 may weigh about 3.5 ounces or less, including the battery 28.

An application software program is stored in the program memory 12. The application software program is configured to operate with the microprocessor 12 and the other electronic components to provide the golf GPS device 10 with the functionality as described herein. Most generally, the hardware and software of the portable golf GPS device 10 are configured to determine, track, and display useful golf related information, before, during and after a round of golf. The GPS device 10 is configured to store golf course data for a particular golf course of interest.

The golf courses are mapped to create the golf course data using any suitable method. The mapping process produces golf course data which can be used by the GPS device 10 to determine the coordinates of golf course features of interest, such as the greens, bunkers, hazards, tees, pin positions, other landmarks, and the like. Generally, the perimeter of the golf course features will be mapped so that distance to the front and back of the feature may be determined. The captured data is used to create a data set comprising the coordinates for a plurality of points on the perimeter of the feature, or a vector-map of the perimeter, or other data, which can be used to calculate the distance to such feature from the location of the GPS device 10. The golf course data preferably also includes golf hole data such as par, handicap, daily tee and hole locations, etc.

Figure 3:
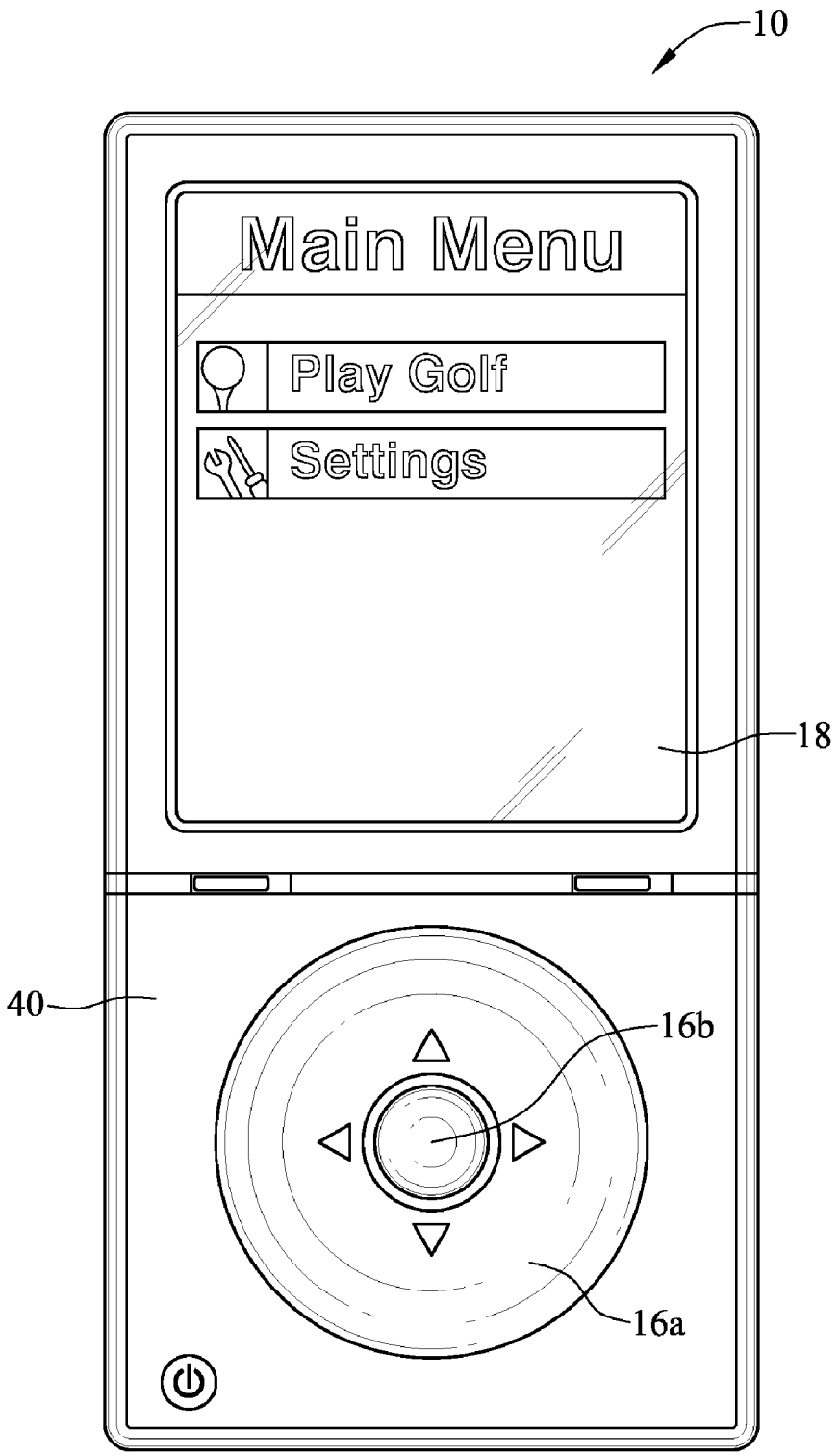
FIG. 3 is front, elevational view of a GPS device with a Main Menu displayed on the display according to one embodiment of the present invention.

With reference now to FIGS. 3-11, the operation and functionality of GPS device 10 according to one embodiment will be described. Referring to FIG. 3, a "Main Menu" screen is displayed on the display 18. The "Main Menu" screen has two options, "Play Golf" or "Settings." The choices on the Main Menu screen (or any of the other menus and screen displays described herein) can be selected by changing the highlighted option using the up and down arrows on the directional pad 16*a* of the user input device 16. The button 16*b* may function as an "Enter" key to make a selection. If a touch screen input device 16 is utilized, the user can simply touch the selection on the display 18.

Selecting "Settings" will bring up a "Settings" menu which allows the user to set various device and player settings and preferences. For example, the "Settings" menu may allow the user to set such user preferences as system units (e.g. yards or meters), preferred display settings (e.g. text size, Pro Mode vs. Basic Mode, screen brightness and contrast), turning on/off functions (such as score keeping, voice recognition, shot tracking, etc.), and other device settings.

Figure 4:
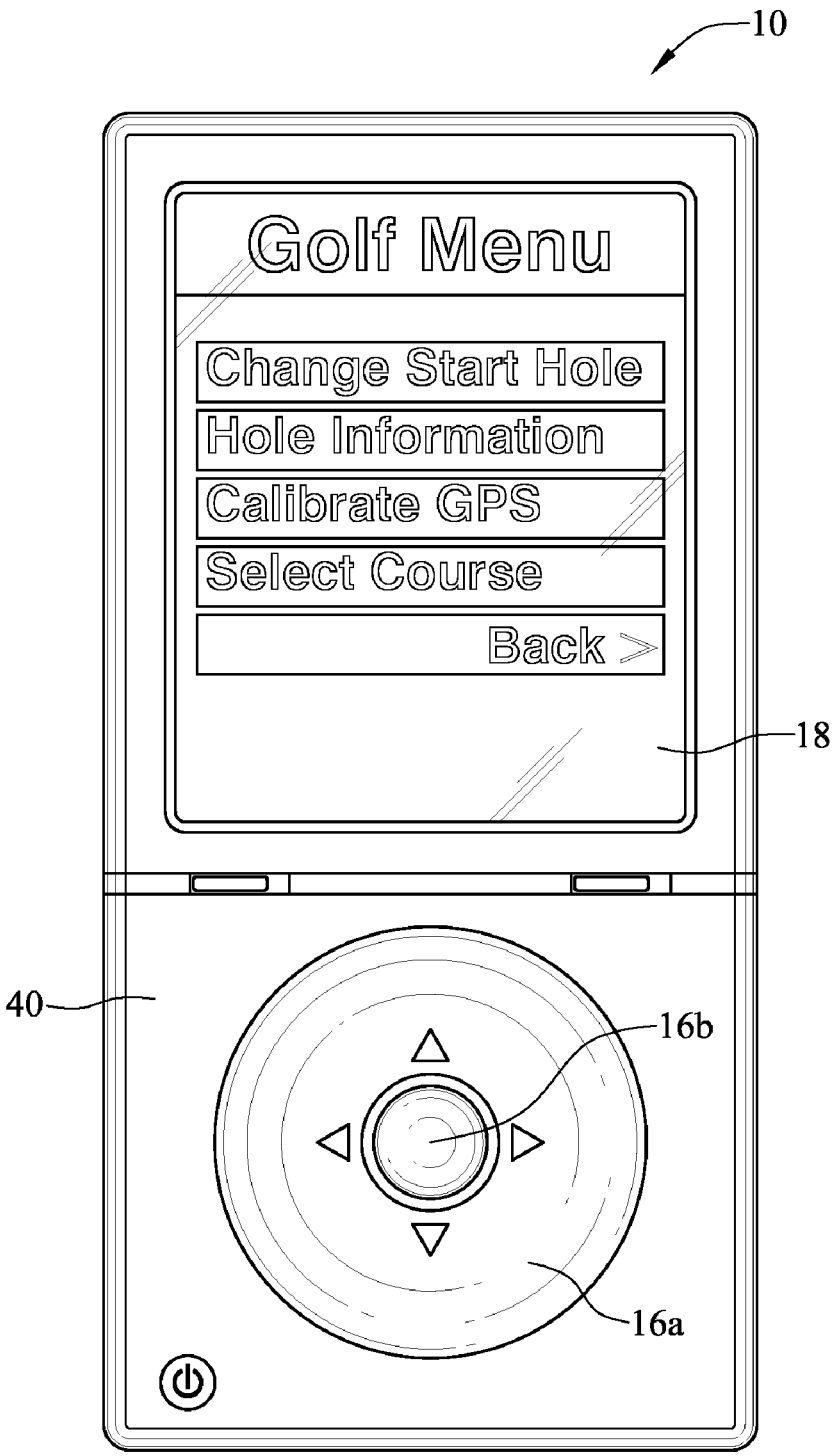
FIG. 4 is front, elevational view of a GPS device with a Golf Menu displayed on the display according to one embodiment of the present invention.

Selecting the "Play Golf" mode brings up a "Golf Menu" as shown in FIG. 4 for initializing the GPS device 10 for use during a round of golf. The course being played may be selected by selecting "Select Course" which may bring up a list of courses currently stored on the device 10. Preferably, the golfer inputs a geographical region which is selected from a list of geographical regions. The list is preferably a list of the States of the United States. Alternatively, the list is a list of the nations of Europe. Alternatively, the list is a list of the Prefectures of Japan. One a region is selected, based on the GPS coordinates, the GPS device will provide a list of courses for selection by the golfer. The list of courses shown can be determined based on the location of the device as determined by the GPS device 10, for example, a list of the two or three courses closest to the location of the device. Alternatively, the list can be generated as a simple alphabetical list, a list of favorites, or other suitable listing method. The "Golf Menu" also allows the user to choose the starting hole, for instance, if a player is going to start on a hole other than the 1st hole, such as starting on the 10th hole (the "back nine").

Figure 5:
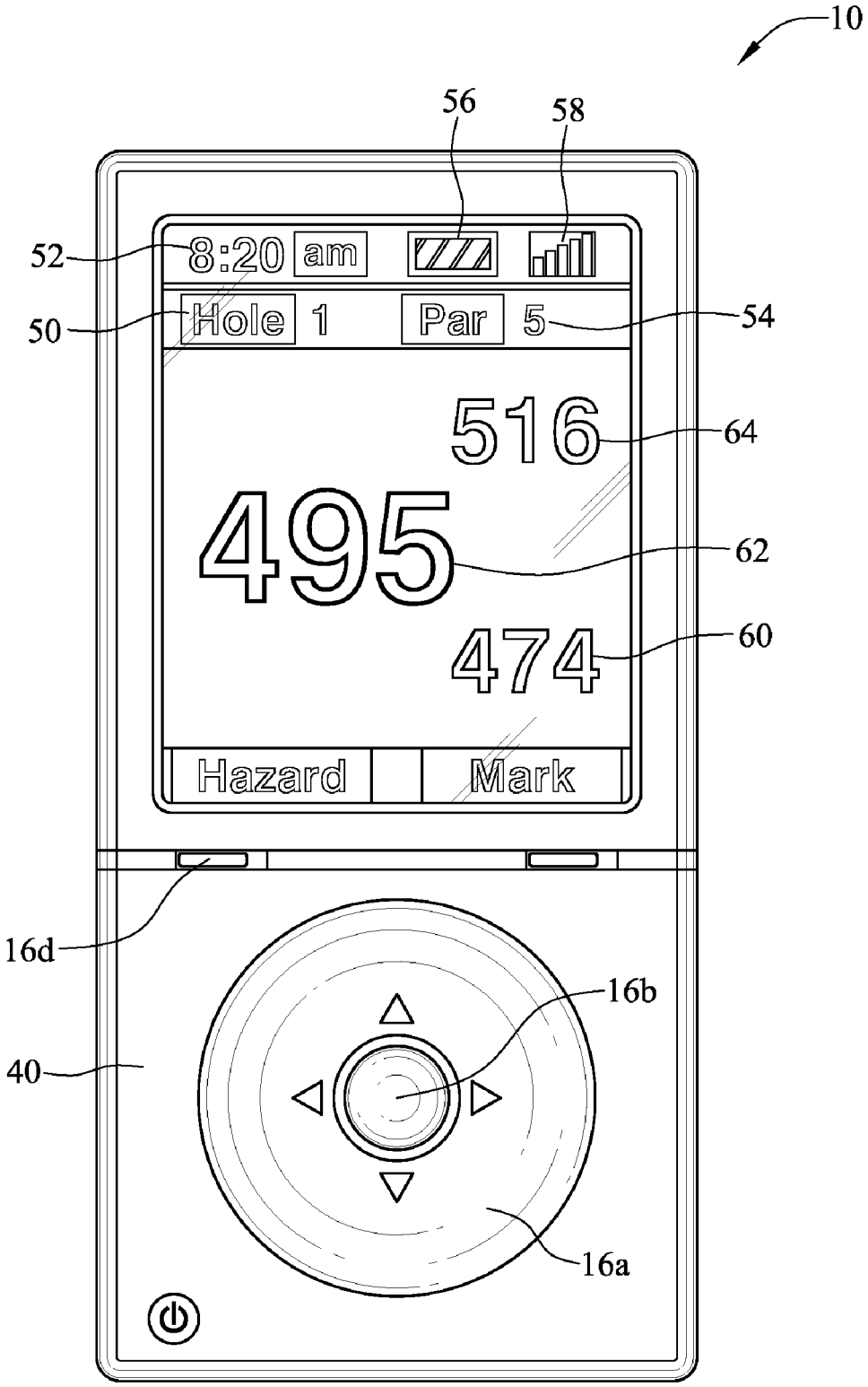
FIG. 5 is front, elevational view of a GPS device with golf hole information displayed on the display according to one embodiment of the present invention.

Once the course and starting hole have been selected, GPS device 10 determines the location of the device 10 using the GPS chipset 14, and then displays various golf hole information on the display. Turning to FIG. 5, in this described embodiment, the GPS device 10 is configured to display the hole number 50, the current time 52 (the device 10 may include a clock function which can be provided by the microprocessor 12, the GPS chipset 14, or other electronic device), the par for the hole 54, a battery charge indicator 56, and a GPS signal strength indicator 58. The GPS device 10 further calculates the distance between the determined location of the device 10 and the front, middle and back of the green and displays the distance to the front 60, the middle 62 and the back 64 of the green. As the device 10 is moved, the location of the device 10 is continually updated, and the distances (such as the front 60, middle 64, and back 64 of green) displayed are updated accordingly.

Figure 6:
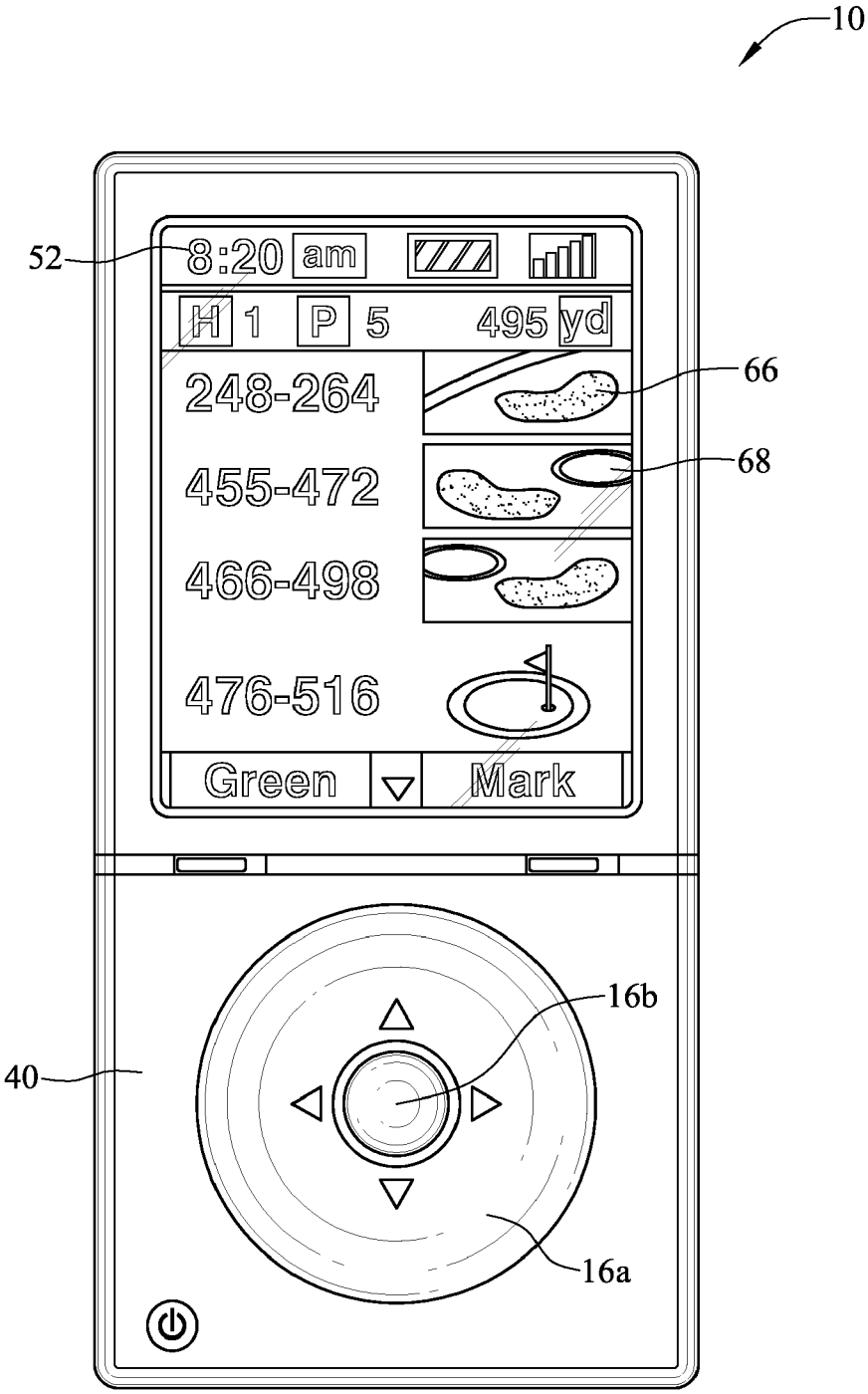
FIG. 6 is front, elevational view of a GPS device with a Hazard view in Basic Mode displayed on the display according to one embodiment of the present invention.

The golf GPS device 10 also may display the distances from the location of the device 10 to hazards and other features of interest as shown in FIG. 6. As an example, the user may select the "Hazard" selection on the display shown in FIG. 5 using the button 16*d* to bring up the screen as shown in FIG. 6. The screen shown in FIG. 6 displays the "Hazard" information in what is referred to herein as "Basic Mode." Basic Mode displays the "Hazard" information in a list using icons or text and respective measured distances. The example of FIG. 6 shows an icon for a right fairway bunker 66 and the distance to the front side of the bunker is 248 yards and the distance to carry the bunker is 264 yards. Similarly, the screen shows that the distance to the left greenside bunker 68 is 455 yards to reach and 472 yards to carry. Instead of easy to read icons, the features can alternatively be displayed using text, such as "Right Fairway Bunker" or using an abbreviation such as RtFwyBnkr, or the like.

In order to optimize the viewability of the golf course animations and displayed distances in the Pro Mode on a relatively small display 18, the golf GPS device 10 may include a automatic, dynamic, viewport generation method. The ability to miniaturize the size of the device 10 is in many ways limited by the size of the display 18, the major tradeoff being the desire to maximize the size of the display 18 in order to be able to display as much information and images at an easily viewable scale, while at the same time keeping the overall size of the device 10 as small as possible. Intelligent generation of the of the images and numbers being displayed can help to display the most relevant section of the golf hole being played with distances displayed at a font size that is easily readable.

Figure 7:
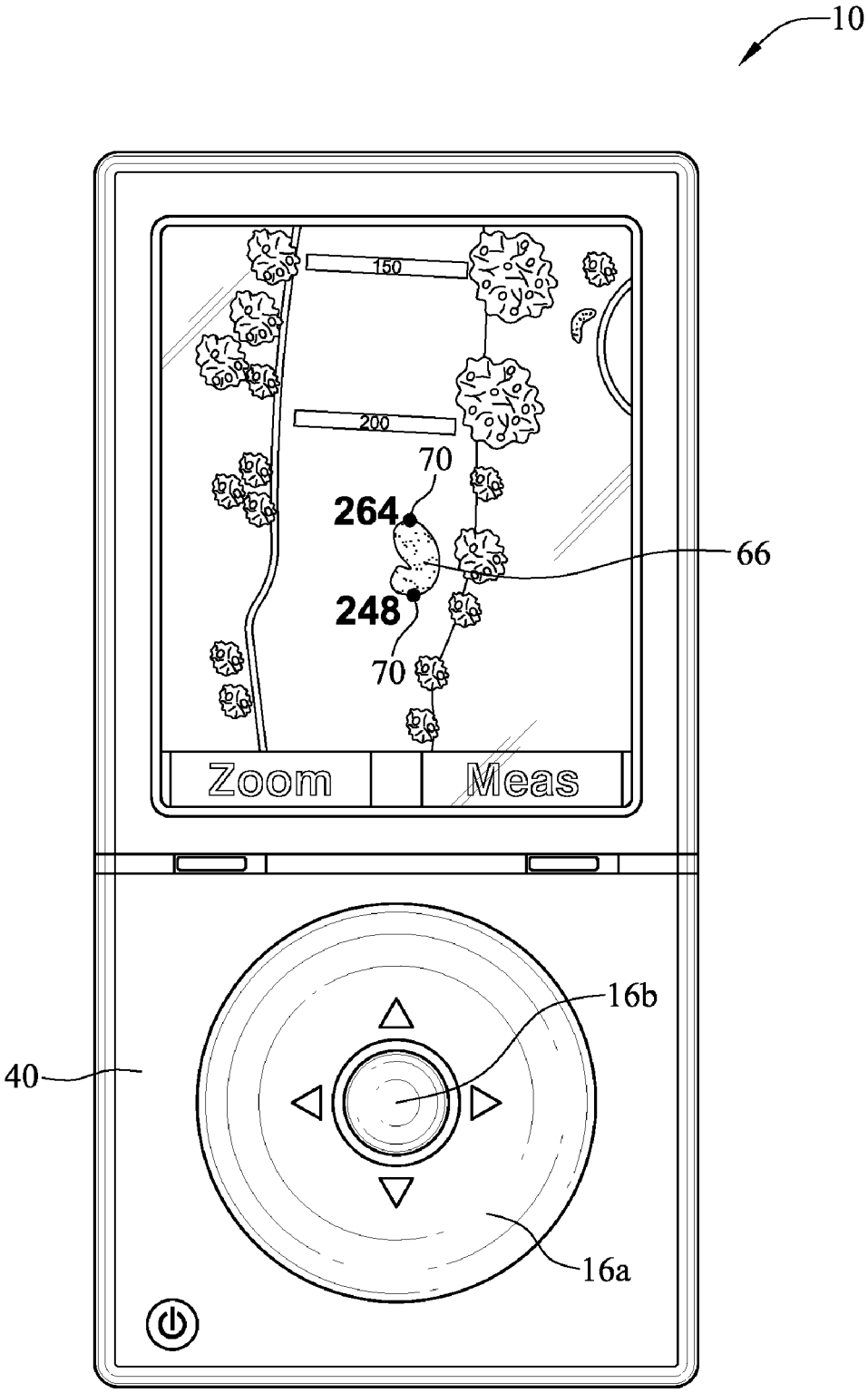
FIG. 7 is front, elevational view of a GPS device with a Pro Mode view displayed on the display according to one embodiment of the present invention.
Figure 8:
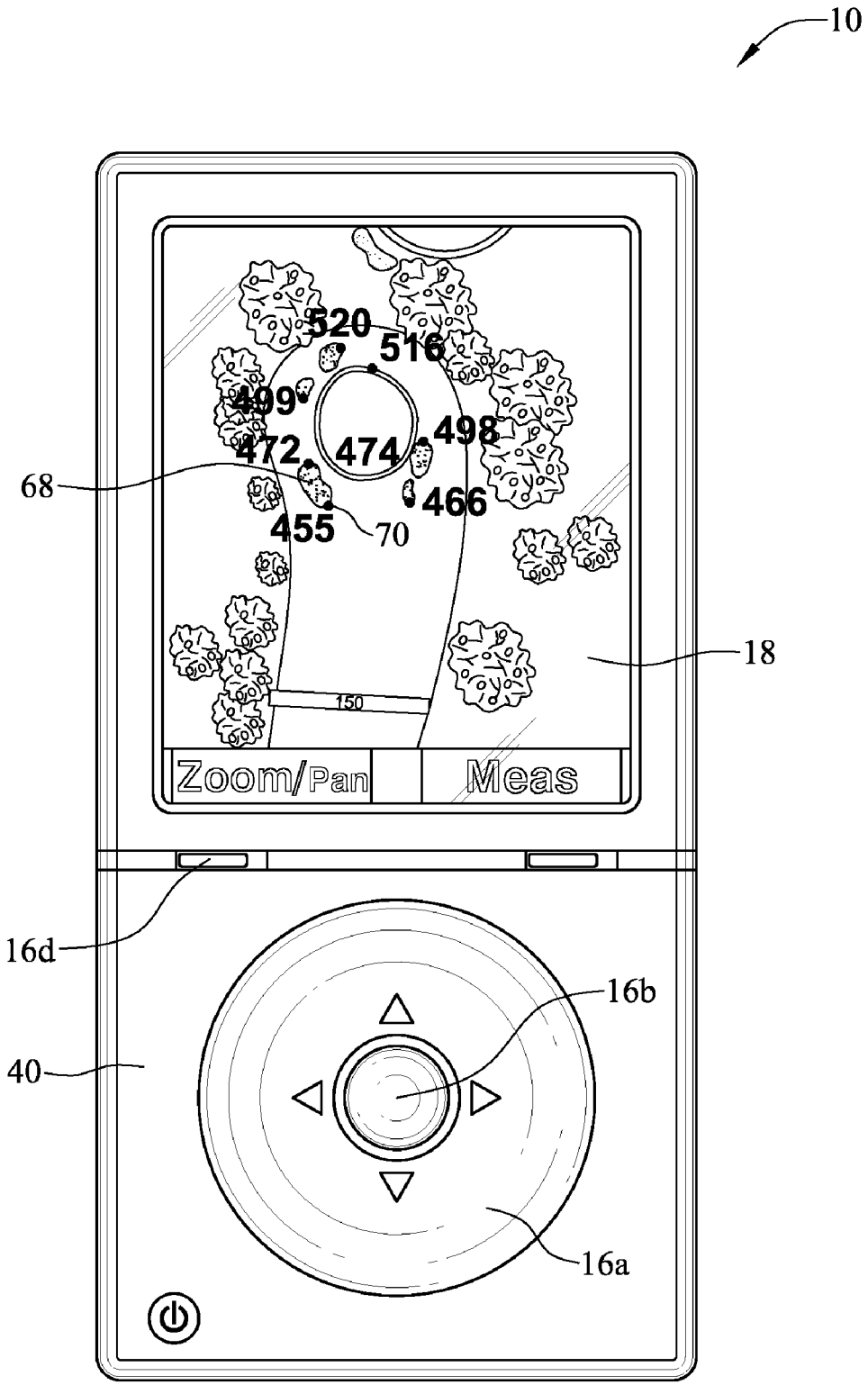
FIG. 8 is front, elevational view of a GPS device with another Pro Mode view displayed on the display according to one embodiment of the present invention.
Figure 9:
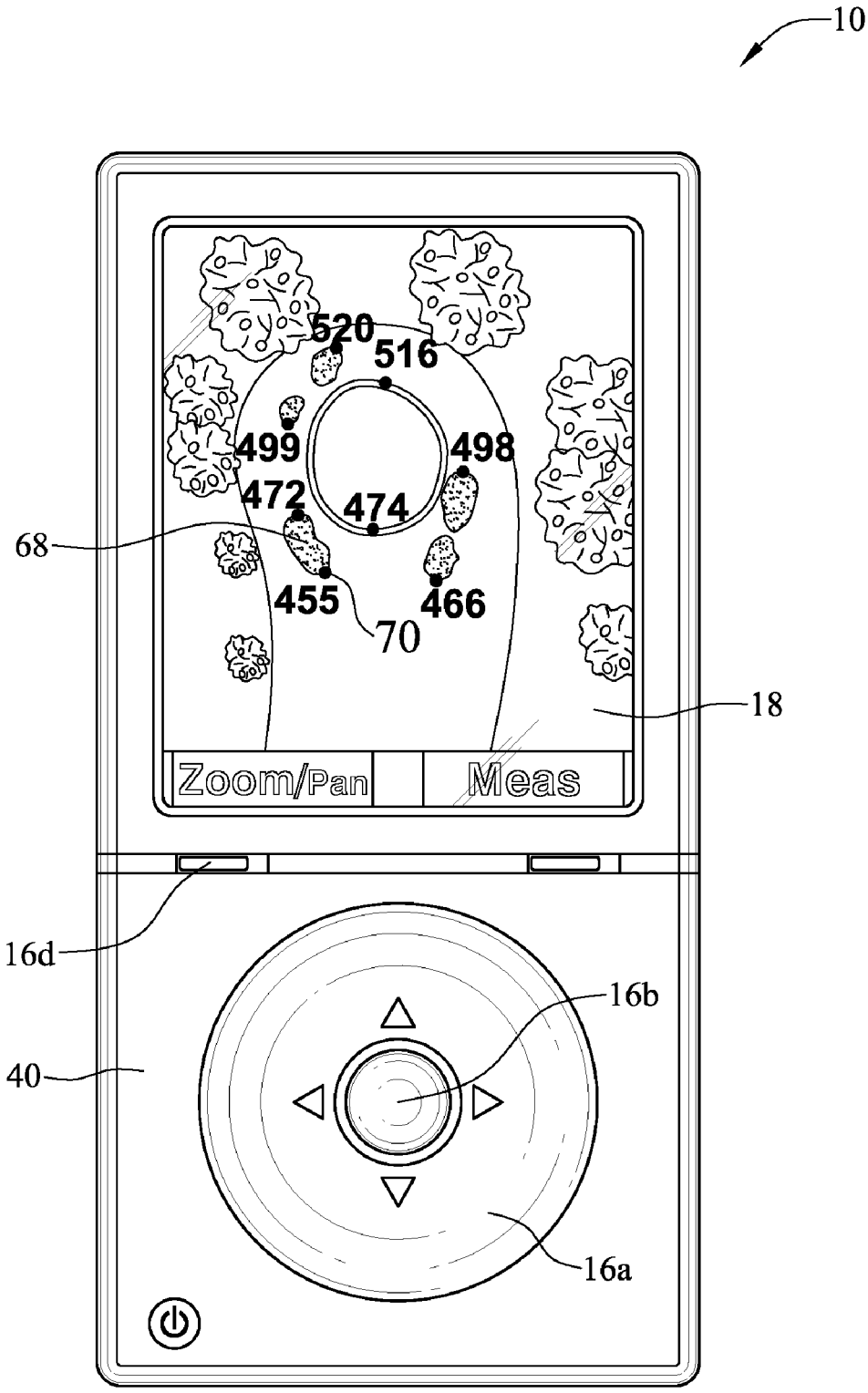
FIG. 9 is front, elevational view of a GPS device with a zoomed in Pro Mode view displayed on the display according to one embodiment of the present invention.

The viewport generation may include one or more methods to determine the displayed viewport. First, the viewport generation method may include a method of determining the location and scale of the animation of the portion of the golf course to be displayed based on the location of the device (and therefore the location of play) and the characteristics of the golf hole. For example, the method of viewport generation method displays the section of the golf hole that will be most relevant to the golfer from the current location, which may be a yardage range such as the fairway which is between 150 and 250 yards from the current location. As one specific example, FIG. 7 shows a viewport which might be displayed if the user is on the tee box of the displayed hole. The viewport displays the fairway and area surrounding the fairway from about 200 yards to 375 yards from the tee. The graphic animation is automatically scaled (i.e. the zoom level is set) to display the relevant section of the hole so that it will fit on the display while maintaining viewability of relevant features (e.g. the bunkers) and distance to the fairway bunker. If the hole happens to be a par 3, or there is less than a certain distance (e.g. 250 yards) to the end of the hole, then the viewport generation method may display the rest of the hole at a maximum zoom level that can fit the rest of the hole on the display (see e.g. FIG. 8).

Figure 10:
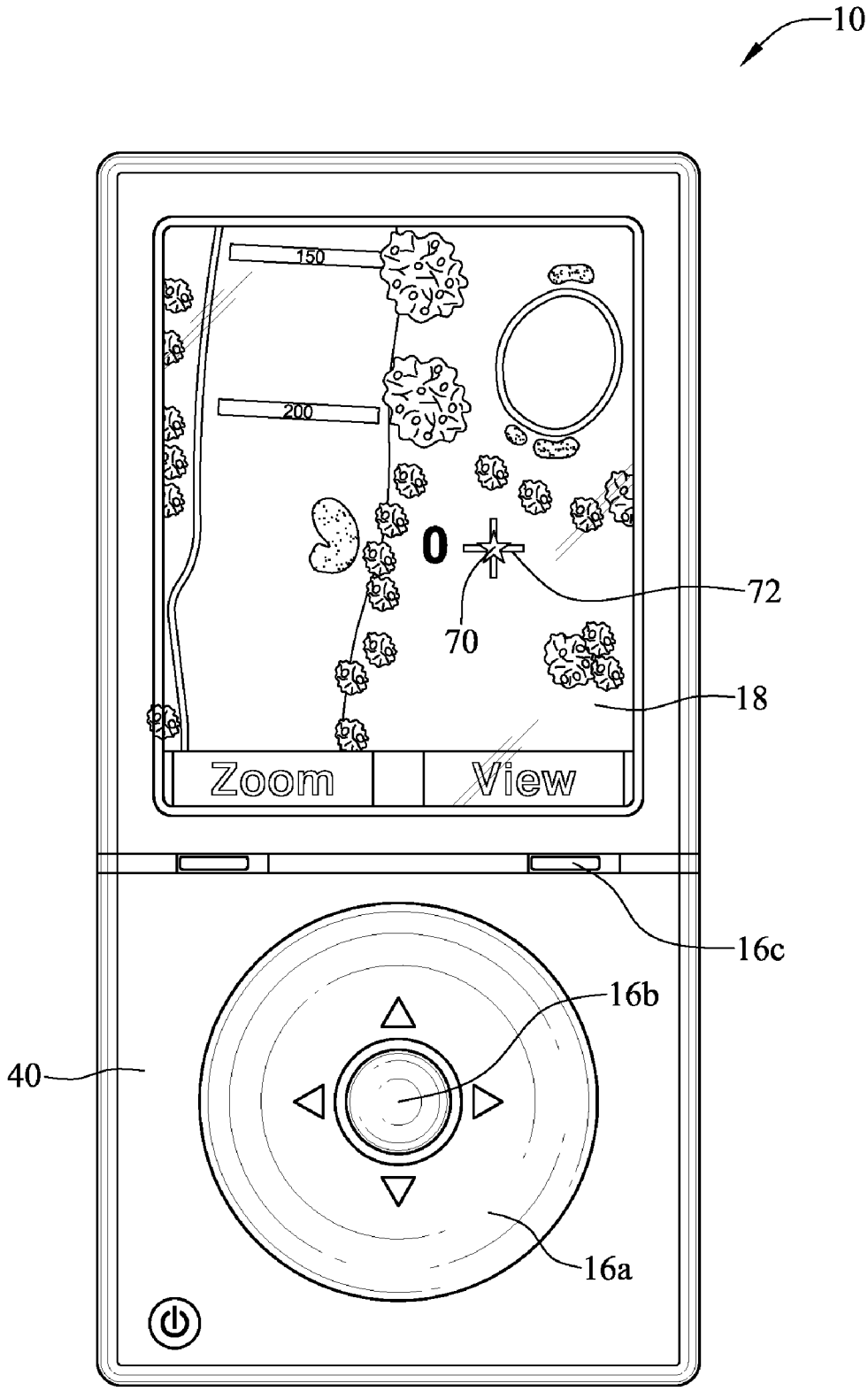
FIG. 10 is front, elevational view of a GPS device in a Measure mode displayed on the display according to one embodiment of the present invention.
Figure 11:
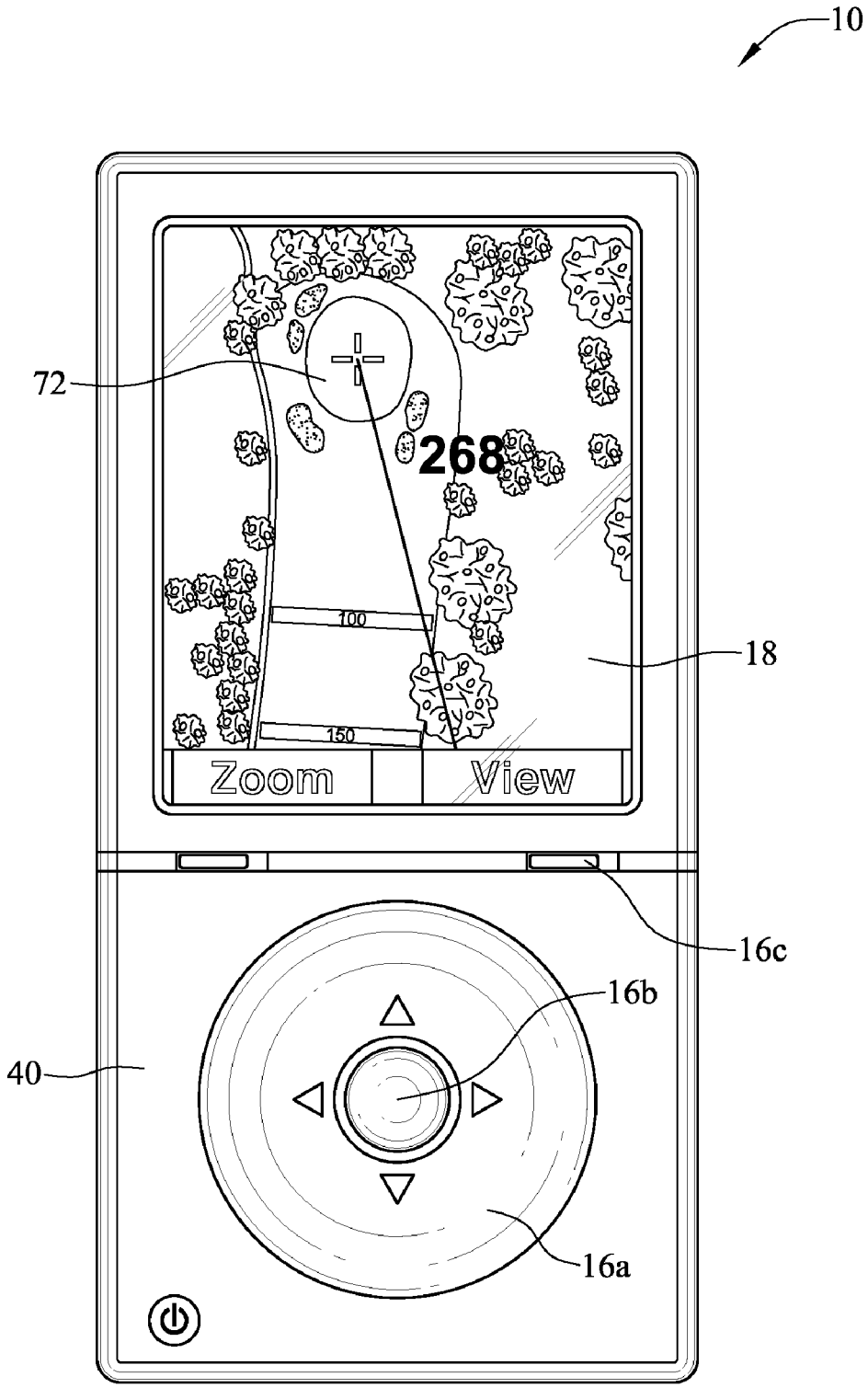
FIG. 11 is front, elevational view of a GPS device with another aspect of the Measure mode displayed on the display according to one embodiment of the present invention.

The golf GPS device 10 may also be configured to measure the distance between locations on the golf course using the animations displayed on the display. In order to measure a distance from the location of the device to a location as viewed on an animation on the display, the "Meas" button 16*c* is selected (see FIG. 9), to enter "Measure" mode as shown in FIG. 10. A cursor 70 (such as a "+") and a marker 72 (such as the star shown in FIG. 10) will appear at the current location of the device 10. The marker 70 indicates the current location of the device 10, and the cursor indicates the point being measured to. At the outset, the marker 70 and cursor 72 are at the same location, so the distance is displayed as "0". The directional pad is then used to move the cursor 72 to the location of interest. As the cursor 72 is moved, the distance between the cursor 72 and the marker 70 is calculated and displayed. As the cursor 72 reaches the edge of the display in the direction of interest, the display may automatically pan (and/or zoom), as shown in FIG. 11. When the cursor is located at the location of interest, the desired distance will be displayed, as shown in the example of FIG. 11. In a similar manner, the device 10 may also be configured to measure the distance between two locations of interest selected on display. The user simply selects the "Meas" mode. The cursor 72 is then positioned at a first point of interest, the button 16*b* is pushed to set the first point of interest, and then the cursor 72 is moved to a second point of interest. As in the example above, the distance between selected first point of interest and the location of the cursor will be updated and displayed as the cursor is moved. The distance between a first location for the device 10 and a second location of the device 10 may also be measured by simply entering the "Meas" mode and then moving the device 10 to a new location. As the device 10 is moved, the distance between the original location of the device 10 and the new location of the device 10 will be calculated and displayed. The pan and zoom functions may be utilized automatically or manually during any of the above described measurement modes in order to select a location of interest.

Figure 12:
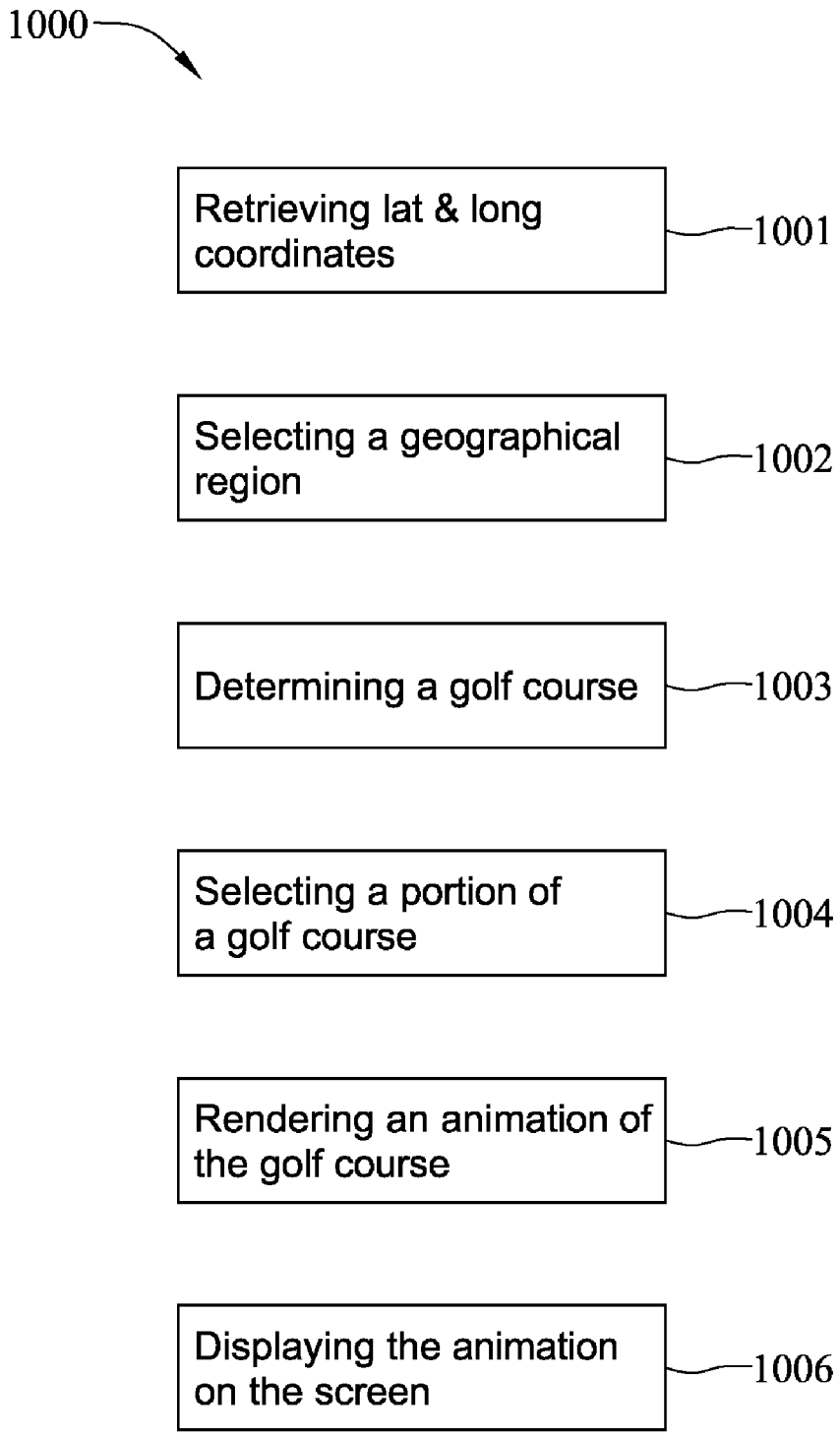
FIG. 12 is a flow chart of a method.

FIG. 12 is a preferred method of the present invention. The method 1000 begins at block 1001 with the GPS device 10 retrieving latitude and longitude coordinates for the present location of the device. At block 1002, the golfer selects a geographical region. At block 1003, the golfer determines a golf course from a list of golf courses. At block 1004, the golfer selects a portion of a golf course such as a green for display on a screen of the device 10. At block 1005, the device 10 renders an animation of the portion of the golf course based on latitude and longitude coordinate points which represent type regions of the green. At block 1006, the device displays the animation of the portion of the golf course.

Figure 13:
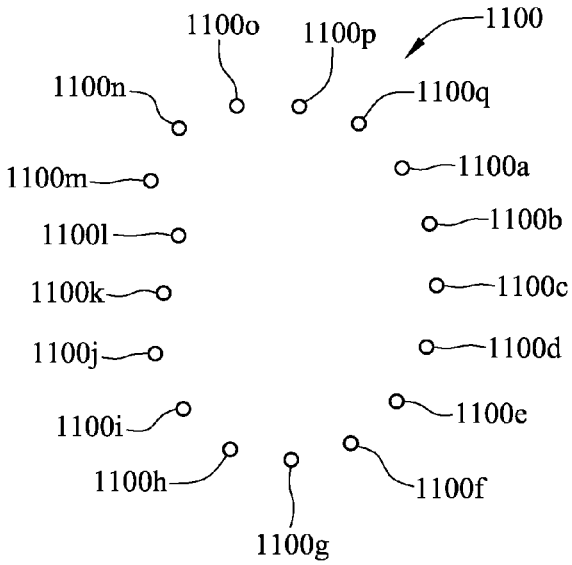
FIG. 13 is a representation of pre-rendering latitude and longitude coordinate points for a region of a portion of a golf course.
Figure 14:
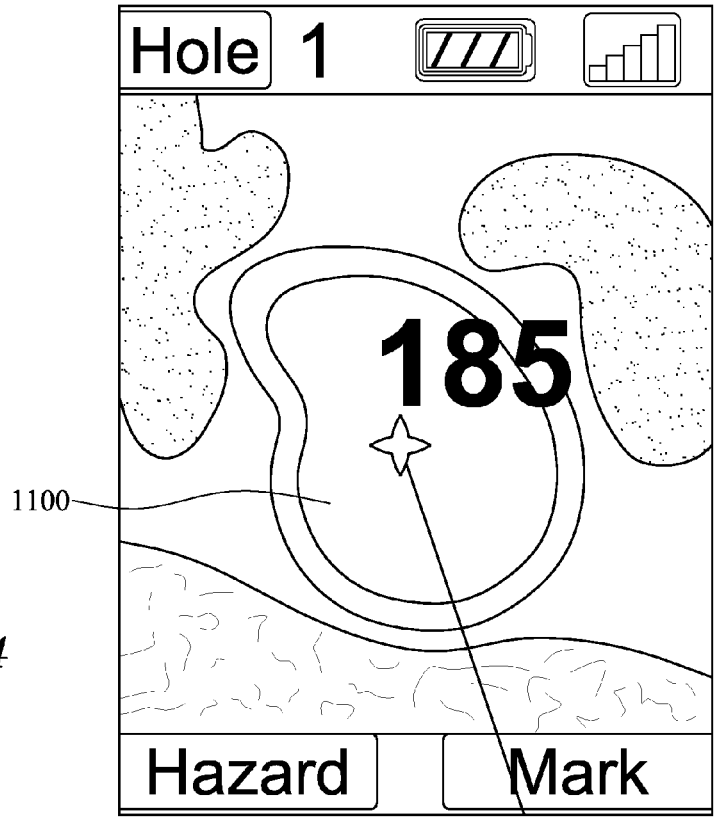
FIG. 14 is an animation of a portion of a golf course that is rendered on a screen of the device.
Figure 15:
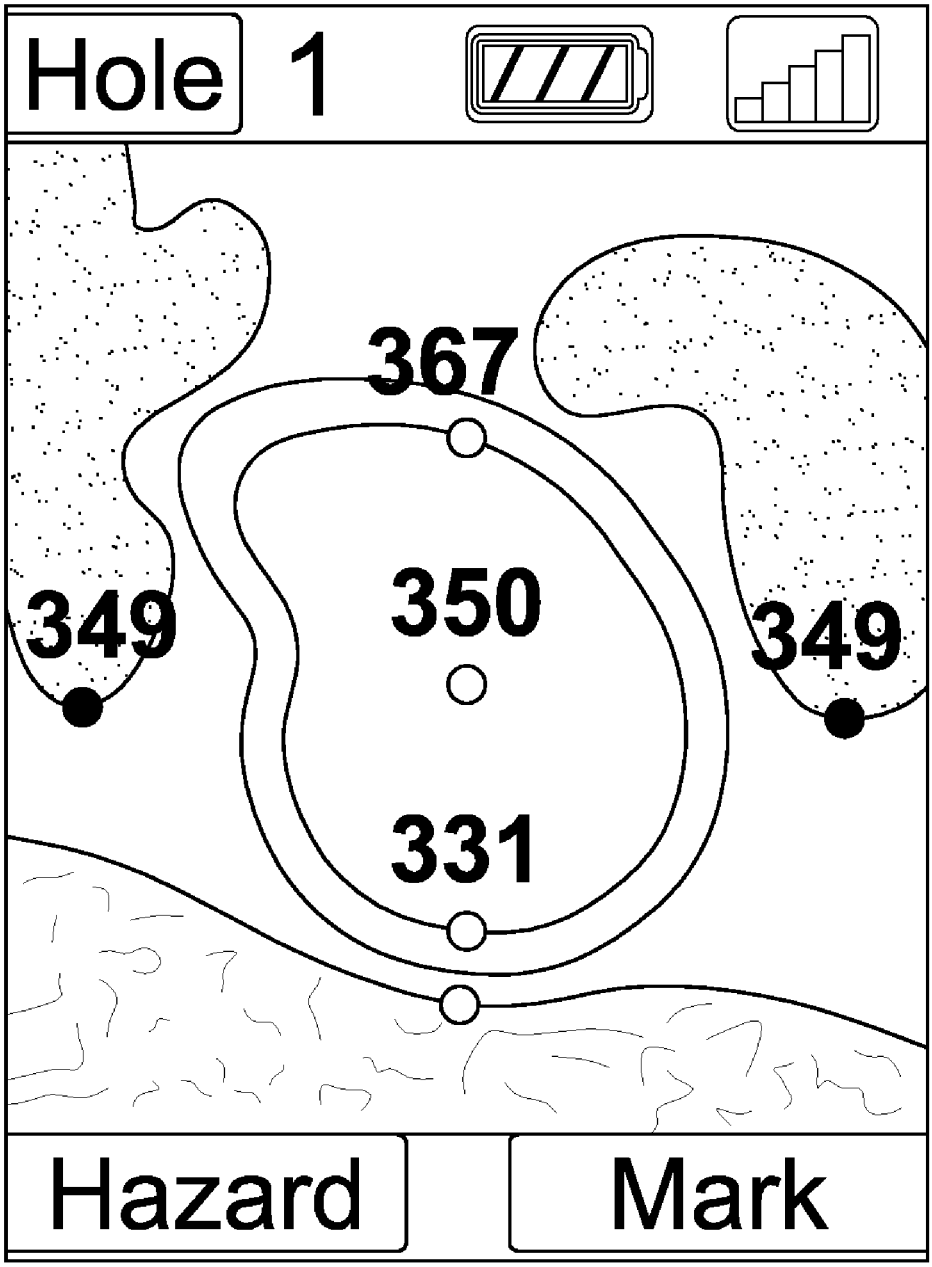
FIG. 15 is an animation of a portion of a golf course that is rendered on a screen of the device with overlapping data.
Figure 16:
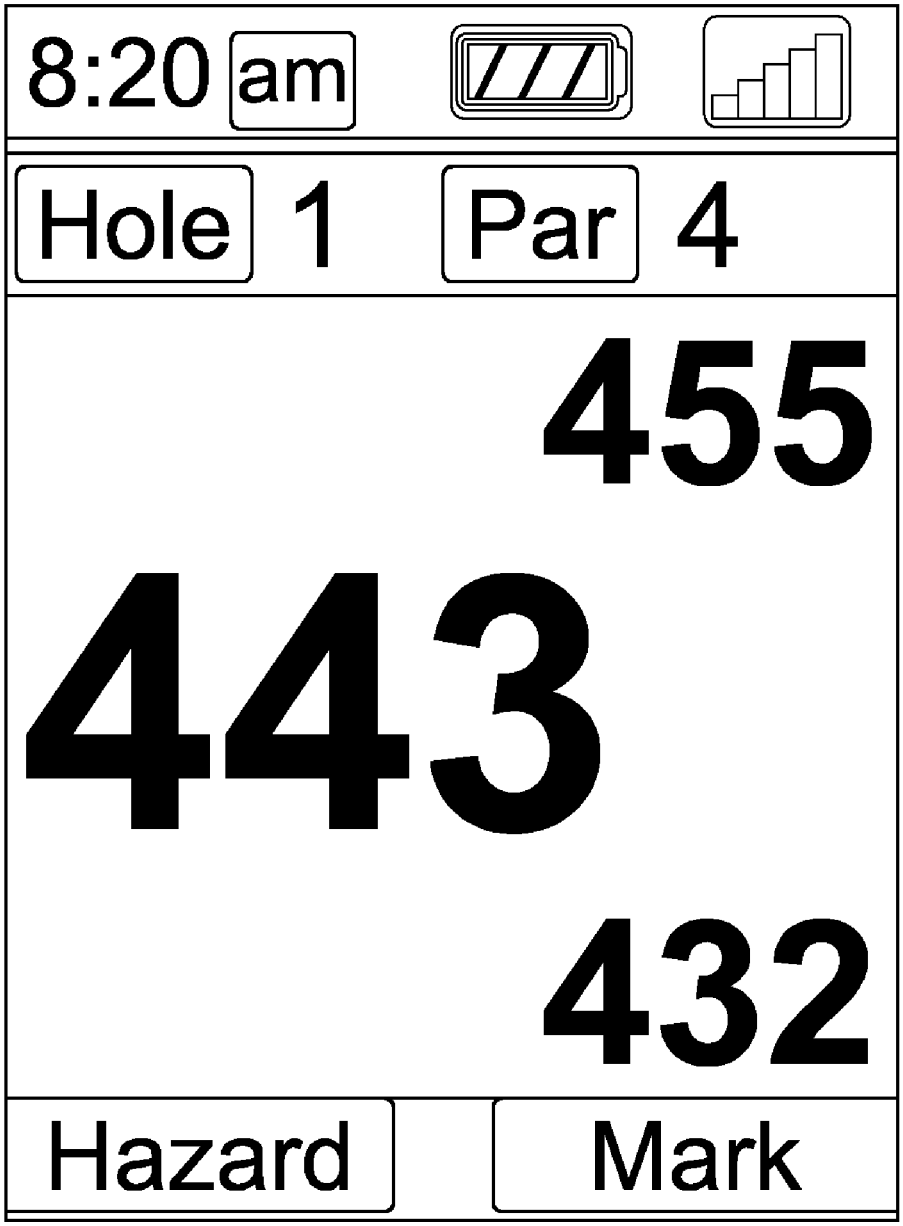
FIG. 16 is an illustration of distance data on a screen of the device.
Figure 17:
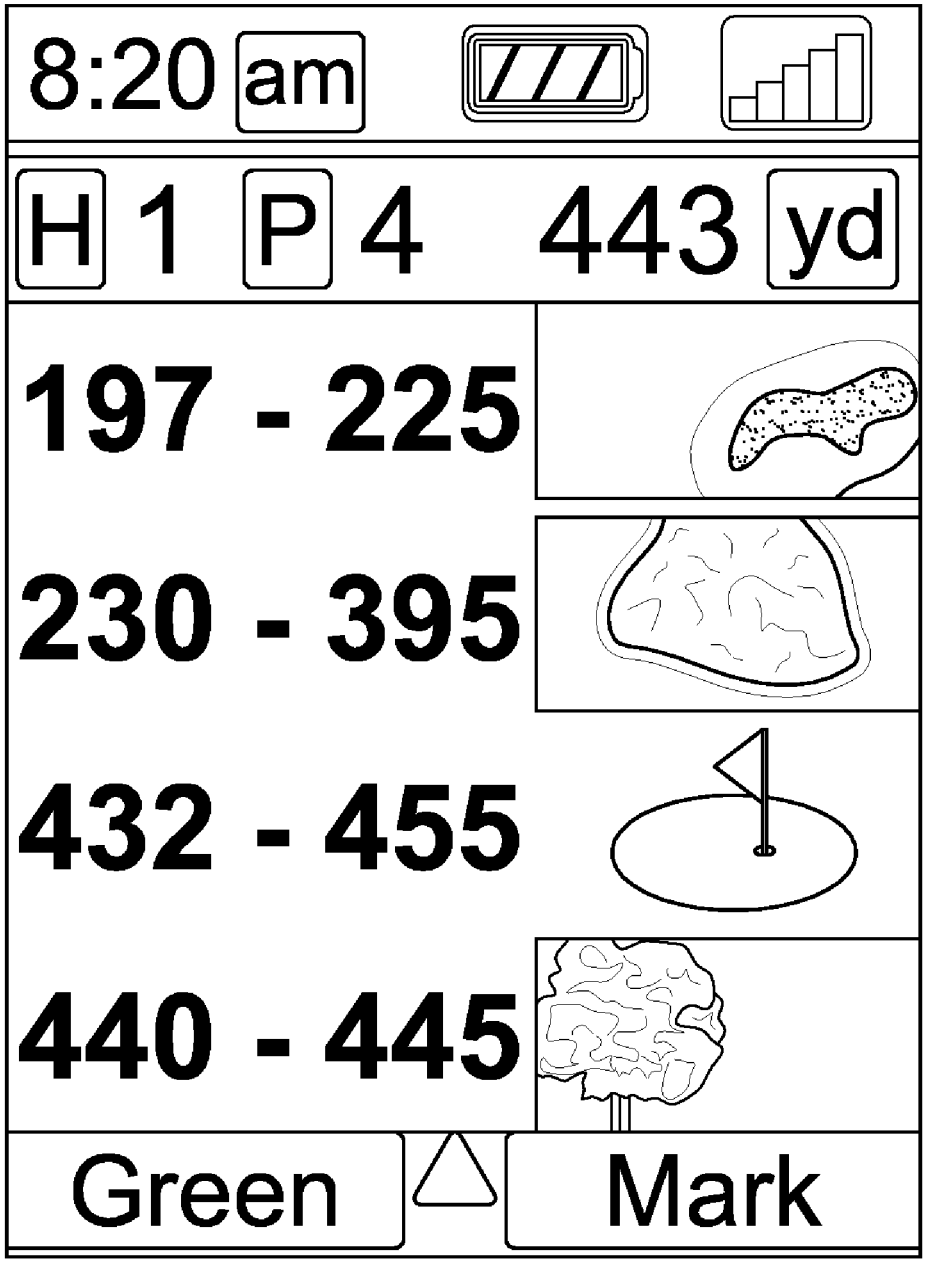
FIG. 17 is an illustration of distance data and animations on a screen of the device.

FIG. 13 is a representation of latitude and longitude coordinate points 1100*a*-1100*q* for a type region 1100 which is a green for a golf course. The latitude and longitude coordinate points 1100*a*-1100*q* are stored on the device as representing a particular green for a particular golf course that has been selected by a golfer. These latitude and longitude coordinate points 1100*a*-1100*q* are stored as green grass such that the animation for the green 1100 is rendered and displayed on the screen of the device 10 when the golfer is at this location or chooses this location for display on the device. FIGS. 15-17 illustrate other information and animations that are shown on screen of the device 10.

The foregoing illustrated and described embodiments of the invention are susceptible to various modifications and alternative forms, and it should be understood that the invention generally, as well as the specific embodiments described herein, are not limited to the particular forms or methods disclosed, but also cover all modifications, equivalents and alternatives falling within the scope of the appended claims. The invention, therefore, should not be limited, except to the following claims, and their equivalents.

We claim as our invention the following:

1. A golf GPS device comprising:

a GPS component, the GPS component configured to obtain a latitude and longitude location point of the golf GPS device;

a memory comprising stored data for a plurality of portions of a plurality of golf courses, wherein the data for a plurality of portions for each of the plurality of golf courses is a plurality of longitude and latitude points, wherein the memory comprises data for 10,000 to 30,000 golf courses;

a display member for displaying a plurality of images;

a user input; and a processor configured to render animations of a portion of a golf course on the display from the stored data for the plurality of portions of the plurality of golf course in the memory based on the latitude and longitude location point of the golf GPS device, wherein the animation of the portion of the golf course is a plurality of type regions, wherein each of the plurality of type regions represents one of green's grass, sand, water, rough grass, fairway grass and a flagstick.

2. The golf GPS device according to claim 1 wherein the GPS component comprises a GPS circuit and GPS antenna.

3. The golf GPS device according to claim 1 wherein the data for the plurality of golf courses is grouped according to a plurality of geographical regions.

4. The golf GPS device according to claim 3 wherein the plurality of geographical regions comprises the States of the United States.

5. A method for displaying a portion of a golf course and a golfer's location on a handheld device, the method comprising:

retrieving latitude and longitude coordinates for a golfer's location using a GPS component of a handheld device;

selecting a geographical region from a plurality of geographical regions on the handheld device;

determining a golf course from a plurality of stored golf courses on the device based on the selected geographical region and the latitude and longitude coordinates for the golfer's location wherein the plurality of stored golf courses comprises data for 10,000 to 30,000 golf courses stored in a memory of the handheld device;

selecting a portion of the golf course for display on a screen of the handheld device;

rendering an animation of the portion of the golf course based on a plurality of type regions of the portion of the golf course, each of the plurality of type regions comprising from 10 to 100 longitude and latitude points, wherein each of the plurality of type regions represents one of green's grass, sand, water, rough grass, fairway grass and a flagstick; and displaying the animation of the portion of the golf course on the screen of the handheld device.

6. The method according to claim 5 wherein the plurality of geographical regions comprises the States of the United States.

7. The method according to claim 5 wherein the plurality of geographical regions comprises the Provinces of Canada.

8. The method according to claim 5 wherein the plurality of geographical regions comprises the Nations of Europe.

9. The method according to claim 5 wherein the plurality of geographical regions comprises States of Australia.

10. The method according to claim 5 wherein the plurality of geographical regions comprises Prefectures of Japan.

11. The method according to claim 5 wherein the plurality of geographical regions comprises the Provinces of China.

12. The method according to claim 5 wherein the portion of the golf course is selected from one of a fairway portion, a green portion or a tee portion.

* * * * *